US008342899B2

(12) United States Patent
Ookahara et al.

(10) Patent No.: US 8,342,899 B2
(45) Date of Patent: Jan. 1, 2013

(54) METHOD OF MANUFACTURING LAMP AND QUARTZ BULB

(75) Inventors: Makoto Ookahara, Saitama (JP); Shoji Yamamoto, Saitama (JP)

(73) Assignee: Iwasaki Electric Co., Ltd., Tokyo (JP)

( * ) Notice: Subject to any disclaimer, the term of this patent is extended or adjusted under 35 U.S.C. 154(b) by 0 days.

(21) Appl. No.: 13/132,208

(22) PCT Filed: Dec. 3, 2008

(86) PCT No.: PCT/JP2008/071976
§ 371 (c)(1),
(2), (4) Date: Aug. 22, 2011

(87) PCT Pub. No.: WO2010/064308
PCT Pub. Date: Jun. 10, 2010

(65) Prior Publication Data

US 2011/0298369 A1 Dec. 8, 2011

(51) Int. Cl.
*H01J 9/00* (2006.01)
*H05B 33/10* (2006.01)

(52) U.S. Cl. ..... 445/26; 445/29; 313/634; 313/573

(58) Field of Classification Search ..... 445/22, 445/26, 29, 33; 313/634, 358
See application file for complete search history.

(56) References Cited

U.S. PATENT DOCUMENTS

| | | | | |
|---|---|---|---|---|
| 4,959,587 | A * | 9/1990 | Schug | 313/623 |
| 5,598,063 | A * | 1/1997 | Mathews et al. | 313/623 |
| 5,994,839 | A * | 11/1999 | Yamamoto et al. | 313/570 |
| 6,218,780 | B1 * | 4/2001 | Ehrlichmann et al. | 313/631 |
| 6,428,379 | B2 * | 8/2002 | Kaneko et al. | 445/26 |
| 6,525,451 | B1 * | 2/2003 | Hishinuma et al. | 313/234 |
| 6,547,619 | B1 | 4/2003 | Ohkawai et al. | |
| 2002/0008476 | A1 * | 1/2002 | Fidler et al. | 313/623 |

FOREIGN PATENT DOCUMENTS

| | | |
|---|---|---|
| JP | 4-104427 | 4/1992 |
| JP | 6-290748 | 10/1994 |
| JP | 8-171851 | 7/1996 |
| JP | 2000-021312 | 1/2000 |
| JP | 2003-151438 | 5/2003 |
| JP | 2003-346654 | 12/2003 |
| JP | 2004-335457 | 11/2004 |
| JP | 3653195 | 5/2005 |

* cited by examiner

*Primary Examiner* — Mariceli Santiago
*Assistant Examiner* — Glenn Zimmerman
(74) *Attorney, Agent, or Firm* — Greenblum & Bernstein, P.L.C.

(57) ABSTRACT

It is intended to enable accurate positioning of an electrode top end such that the arc length is constant and prevent leakage from sealing portions due to bending or twisting of a molybdenum foil upon sealing an electrode mount by heating the sealing portion. For attaining the object described above, a quartz bulb in which extension tubes each having an inner diameter larger than the inner diameter of the opening of a body tube is welded the openings of both ends of a body tube formed with light emitting portion and a sealing portion thereby forming to a positioning step is used, and electrode mounts each formed with a positioning engagement portion at a position spaced apart by a predetermined length from the electrode top end are inserted to engage the positioning engagement portion of the electrode mounts to the positioning step and, in this state, the sealing portions are sealed.

13 Claims, 6 Drawing Sheets

10
11
12
13A
13B
14A
14B
15
16
17A
17B
20A
20B
21
22
23
23a
24
1

14A
13A
12
11
13B
14B
16
15
10

17A
15
14A
13A
12
11
13B
10
14B
24
21
20A
22
23
23a
16

17B
24
21
20B
22
23
23a
16
14B
15
13B
12
13A
20A
11
10
14A 57
54
58
55
56
52A
53
52B
51

59
58
57
53
52A
52B
51

59
58
52A
57
53
52B
51

METHOD OF MANUFACTURING LAMP AND QUARTZ BULB

TECHNICAL FIELD

The present invention concerns a method of manufacturing a lamp including a quartz bulb having a chamber formed as a light emitting portion to an intermediate portion in the longitudinal direction of a quartz tube and straight tubular sealing portions formed on both ends thereof, in which electrode mounts are inserted from the openings of both ends and the sealing portions are sealed in a state of keeping the inside at a negative pressure, as well as a quartz bulb used therefor.

BACKGROUND ART

In high pressure discharge lamps generally used at present, for example, headlights for automobiles and backlights for projectors, since rupture may be caused during operation at high temperature and high pressure when the thickness distribution of the discharge bulb is not uniform, discharge bulbs of uniform wall thickness with no exhaust tube remains (tips) in the light emitting portion are used and they are also referred to as tipless lamps.

A tipless lamp of this type is manufactured by a method of using, for example, as shown in FIG. 5(*a*) to (*c*), a quartz bulb 51 having a chamber 53 formed as a light emitting portion to a longitudinally intermediate portion of a quartz tube and straight tubular sealing portions 52A and 52B formed on both ends thereof, and electrode mounts 57 each formed by welding a tungsten electrode 56 by way of a molybdenum foil 55 to the top end of a lead wire 54, inserting the electrode mounts 57 inside the quartz bulb 51, and sealing them in a state of keeping the inside at a negative pressure.

[Patent Document 1] JP No. 3653195

In this case, for conforming the arc length (inter-electrode distance) to a designed value, it is required to position the top end of the electrode 56 at a predetermined position in the chamber 53.

Then, in the existent electrode mount 57, a pressing portion 58 for tube inner wall is formed by bending a lead wire 54 into a W-shaped configuration.

With the constitution described above, when the electrode mount 57 is inserted into the quartz bulb 51, since the pressing portion 58 is pressed to the inner peripheral surface of the quartz bulb 51 to result in frictional force, and, as a result, the electrode mount 57 can be fixed temporarily at an optional portion, the electrode mount 57 can be positioned without displacement unless external force is exerted.

In the same manner, in Patent Document 2, a U-shaped pressing portion for tube inner wall is formed to an electrode mount such that the electrode mount can be fixed temporarily with no positional displacement.

[Patent Document 2] JP-A-2000-21312

However, it is difficult by the method of causing the frictional force and fixing the electrode mount 57 at an optional position, it is difficult to confirm whether the electrode mount is positioned to an accurate position or not. Then, the electrode mount is inserted to an appropriate position while monitoring the position by using a magnifying scope such as a CCD camera, this undergoes a lens effect such as deflection or distortion of glass, tends to cause errors in adjustment and result in scattering of an arc length.

Further, upon sealing, after temporarily sealing the upper end 59, sealing is conducted from the vicinity of the tungsten electrode 56 to the molybdenum foil 55 and the lead wire 54 successively (refer to FIG. 5(*b*)).

In this case, since not only the electrode mount 57 is positioned by the pressing portion 58 for a tube inner wall in the W-shaped or U-shaped configuration but also the upper end 59 is temporarily sealed, the molybdenum foil 55 tends to be twisted due to thermal expansion of the molybdenum foil 55 and such twisting of the molybdenum foil 55 may lead to the leakage in the sealing portion which may possibly cause failure in the manufacture.

Therefore, it has been proposed a method of manufacturing a lamp of providing a protrusion 63 to the inner circumference of a portion as sealing portions 62 and 62 of a quartz bulb 61 (refer to FIG. 6(*a*)) or forming an inner flange 65 between a light emitting portion 64 and a sealing portion 62 of a quartz bulb 61 as shown in FIG. 6(*b*), and engaging the positioning engagement portion 66 to the protrusion 63 or the inner flange 65 using an electrode mount 67 having a positioning engagement portion 66 formed at a position spaced apart by a predetermined length from the top end of the electrode, thereby capable of accurately positioning the top end of the electrode.

[Patent Document 3] JP-A-H06-290748

However, in a case of forming the protrusion 63 to the inner surface of the sealing portion 62, it is necessary to inwardly deform a portion where the protrusion is to be formed by pressing a roller 68 to the portion while heating the portion. Such fabrication is not only troublesome but also may vary the shape of the protrusion 63 depending on the size of the quartz tube (particularly, for wall thickness) or other heating condition, etc. and the arc length tends to vary in a case where the electrode is positioned with the protrusion 63 as a reference.

Further, in a case of forming the inner flange 65 between the light emitting portion 64 and the sealing portion 62, since it is necessary to insert a router 69 from the opening of the quartz bulb 61 and ream the inner surface of the sealing portion 62 made of a quartz tube of a high hardness, it involves a problem that the fabrication is difficult tending to cause cracking, the yield is low, and the productivity is poor.

Further, for removing thermal strains in the tipless lamp during fabrication, annealing is generally conducted after completing the lamp and higher pressure resistant strength can be obtained by applying annealing at an appropriate temperature.

Patent Document 4: JP-A-2004-335457

However, since the temperature during annealing is extremely high, metal leads exposed to the outside are oxidized when the completed lamp is annealed. Accordingly, for annealing, a special device such as a vacuum baking furnace, a vacuum heating furnace, etc. capable of performing heat treatment in a vacuum atmosphere are necessary.

Further, for satisfying the requirement for higher efficiency and longer working life of the lamp, quartz at high purity has been used for the quartz bulb and the material cost is outstandingly expensive compared with existent quartz. When a tipless lamp is manufactured, since both ends are cut off, the quartz bulb has to be formed previously to a sufficient length more than that of an actual lamp and, since expensive quartz tube at an extremely high purity has to be used also for a portion which is finally cut off and discarded, there is a problem that the material cost is increased.

DISCLOSURE OF THE INVENTION

Subject to be Solved by the Invention

Then, the technical subject of the present invention is, at first, that the top end of the electrode can be positioned accurately such that the arc length is constant, secondly, that leakage is not caused to the sealing portion due to the bending or twisting of the molybdenum foil upon heating the sealing portion for sealing the electrode mount, thirdly, that annealing treatment can be conducted without using a special device such as an autoclave for obtaining high pressure resistance and with no oxidization of the electrode leads and, fourthly, that the material cost can be decreased.

Means for Solving the Subject

For solving the subjects, a method of manufacturing a lamp according to claim 1 including a quartz bulb having a chamber formed as a light emitting portion to a longitudinally intermediate portion of the quartz tube and straight tubular sealing portions formed on both ends thereof, in which electrode mounts are inserted from the openings of both ends and the sealing portions are sealed in a state of keeping the inside at a negative pressure includes;

a) forming a positioning step to the quartz bulb by welding an extension tube having an inner diameter larger than the inner diameter of an opening to at least one of the openings of a body tube where the light emitting portion and the sealing portion are formed, and forming a positioning engagement portion to the electrode mount at a position spaced apart by a predetermined length from the top end of the electrode, b) inserting the electrode mount from the opening on the side formed with the step in a state of sealing the opening on the side opposite to that formed with the positioning step, and temporarily sealing the opening while maintaining the inside at a negative pressure, c) standing the quartz bulb and engaging the positioning engagement portion of the electrode mount to the positioning step and, in this state, sealing the sealing portion while transiting a portion to be heated from the light emitting portion to the upper opening of the body tube, and thereby sealing the electrode mount and then d) cutting the ends of the quartz bulb containing the electrode mounts sealed therein, thereby removing respective extension tubes to form the quartz bulb to a predetermined length.

According to the method of claim 2, the positioning step is formed to the openings of both ends of the quartz bulb, and a pair of electrode mounts are inserted from the openings of both ends and sealed successively.

According to the method of claim 3, the electrode mount is formed by welding a tungsten electrode by way of a molybdenum foil to the top end of an electrode lead, and an engagement made of metal as the positioning engagement portion that is engaged to the positioning step is attached to the electrode lead at a position spaced apart by a predetermined length from the top end of the electrode.

According to the method of claim 4, the electrode mount is formed by welding a tungsten electrode by way of a molybdenum foil to the top end of an electrode lead, and forming a bent portion by bending the electrode lead at a position spaced apart by a predetermined length from the top end of the electrode as the positioning engagement portion.

According to the method of claim 5, the lamp is annealed entirely in a state of keeping the electrode lead airtightly manner inside the extension tube after sealing the electrode mount and before cutting off both ends thereof.

According to the invention of claim 6, a quartz bulb used for manufacturing a lamp has a chamber formed as a light emitting portion to a longitudinally intermediate portion of a quartz tube and straight tubular sealing portions formed on both ends a body tube, in which a positioning step is formed to at least one of the openings of the body tube by welding an extension tube having an inner diameter larger than the inner diameter of the opening.

In the quartz bulb according to claim 7, the extension tube is formed of quartz at a lower purity than that of the body tube.

In a quartz bulb according to claim 8, the extension tube is formed of a quarts tube having a wall thickness smaller than that of the body tube.

In a quartz bulb according to claim 9, the positioning step is formed to the openings of both ends of the body tube.

Effect of the Invention

According to the invention, since the positioning step is formed to the openings of both ends of the body tube of the quartz bulb by welding the extension tube having an inner diameter larger than that of the inner diameter of the opening the positioning step is formed accurately to the openings of both ends of the body tube.

Accordingly, the positioning step can be formed at an extremely accurate position by merely welding the extension tube to the body tube of a predetermined length without thermally deforming the sealing portion caused by pressing of a roller, or without reaming the body tube of the inside of the sealing portion by a router or the like.

In the electrode mount, the engagement made of metal is attached to the electrode lead as shown in claim 2, or a positioning engagement portion is formed by bending the electrode lead as shown in claim 3 at a position spaced apart by a predetermined length from the top end of the electrode.

The top end of the electrode can be positioned to an accurate position and scattering is not caused to the arc length, by inserting the electrode mount into the body tube, standing the quartz bulb, and engaging the positioning engagement portion of the electrode mount to the positioning step.

When the electrode mount is sealed by sealing a sealing portion while transiting a portion to be heated from the light emitting portion to the upper opening of the body tube, since the positioning engagement portion of the electrode mount is merely engaged at the positioning step, even if the molybdenum foil of the electrode mount is thermally expanded in the course of sealing, the positioning engagement portion is detected upward from the engagement step to prevent the molybdenum foil from bending or twisting, and leakage is not caused in the sealing portion.

Further, when the quartz bulb is annealed in a state of keeping the electrode lead airtightly in the extension tube after sealing the electrode amount and before cutting off both ends thereof, since the metal lead is not exposed to an external air, heat treatment can be conducted in an atmospheric air without using any special device such as an autoclave.

As described in claim 7, when a quartz bulb formed of quartz at a purity lower than that of the body tube is used for the extension tube, since an inexpensive quartz tube containing much impurity can be used for the extension tube to be cut off, the proportion of an expensive quartz tube included in the portion to be discarded can be decreased to lower the cost.

Further, as described in claim 8, when the extension tube is formed of a quartz tube at a wall thickness smaller than that of the body tube, since quartz material in the portion to be cut off can be decreased, the cost can be decreased also in a case of using a quartz tube at high purity, all the more in the case of using quartz at low purity as described in claim 7.

BEST MODE FOR PRACTICING THE INVENTION

For attaining the purpose of accurately positioning the top end of the end of the electrode so that the arc length is made constant, and preventing leakage from the sealing portion by the bending or twisting of the molybdenum foil upon sealing the electrode mount by heating the sealing portion, this embodiment provides a method of manufacturing a lamp which includes a quartz bulb having a chamber formed as a light emitting portion a longitudinally intermediate portion of the quartz tube and straight tubular sealing portions formed on both ends thereof, in which electrode mounts are inserted from the openings of both ends and the sealing portions are sealed in a state of keeping the inside at a negative pressure, wherein the method includes;

a) forming a positioning step by welding an extension tube having an inner diameter larger than the inner diameter of an opening to the quartz bulb to at least one of the openings of a body tube where the light emitting portion and the sealing portion are formed, and forming a positioning engagement portion to the electrode mount at a position spaced apart by a predetermined length from the top end of the electrode, b) inserting the electrode mount from the opening on the side formed with the step in a state of sealing the opening on the side opposite to that formed with the positioning step, and temporarily sealing the opening while maintaining the inside at a negative pressure, c) standing the quartz bulb and engaging the positioning engagement portion of the electrode mount to the positioning step and, in this state, sealing the sealing portion while transiting a portion to be heated from the light emitting portion to the upper opening of the body tube, thereby sealing the electrode mount, and then d) cutting the ends of the quartz bulb containing the electrode mounts sealed therein, thereby removing respective extension tubes to form the quartz bulb to a predetermined length.

The present invention is to be described with reference to the examples shown in the drawings.

FIG. 1 is an entire step view showing an example of a method of manufacturing a lamp according to the invention, FIG. 2 is a manufacturing step view showing steps of manufacturing a quartz bulb, FIG. 3 is a step view for sealing one of electrode mounts and FIG. 4 is a step view for sealing the other of the electrode mounts.

Example 1

In this example, a method of manufacturing a super-high pressure mercury lamp 1 at 150 W rating is to be described.

According to the method of the invention, electrode mounts 20A and 20B are inserted into a quartz bulb 10 from the openings of both ends thereof and they are sealed in a state of keeping the inside at a negative pressure.

FIG. 1 shows an entire step view which includes a sealing step for a first electrode mount of sealing the first electrode mount 20A inserted from one end of the quartz bulb 10 (FIG. 1(*a*) to (*b*)) manufactured by a quartz bulb fabrication step (refer to FIG. 2), a sealing step for a second electrode mount of sealing the second electrode mount 20B inserted from the other end thereof (FIG. 1(*c*) to (*d*)), an annealing step of removing strains caused in quartz, and a cutting step of cutting off both ends of the quartz bulb 10 to a predetermined length (FIG. 1(*e*)), in which each of the steps includes further divided steps.

[Quartz Bulb Fabrication Step]

In the quartz bulb 10, a chamber 12 as a light emitting portion is formed to the longitudinally intermediate portion of a quartz tube, and extension tubes 14A and 14B are welded to the openings of both ends of a body tube 11 having both ends formed into sealing portions 13A and 13B of a straight tubular shape.

For the body tube 11, a quartz tube at high purity of 2 mm inner diameter and 6 mm outer diameter, for example, PH370 manufactured by Phillips Co. is used and, as shown in FIG. 2(*a*), a chamber 13 is formed by expanding a central portion to a substantially spheroidal shape of 10 mm outer diameter and 4 mm inner diameter as a light emitting portion.

Then, straight tubular sealing portions 13A and 13B to be sealed are extended symmetrically on both sides of the chamber 12 as a center and the portions described above are formed with a one piece tubular quartz member.

The body tube 11 is adjusted to an entire length of 73 mm by a cutting grinder such that the length of the sealing portions 13A and 13B is almost the same length.

To the openings of both ends of the body tube 11, extension tubes 14A and 14B each having an inner diameter larger than the inner diameter of the opening are welded to form a quartz bulb 10 having positioning steps 15 formed therein.

For the extension tubes 14A and 14B, a quartz tube having an inner diameter larger than the inner diameter of the opening of the body tube 11, and a wall thickness smaller than that of the body tube 11 is used. In this example, a general-purpose quartz tube of lower quartz impurity than that of the body tube 11 having 3.5 mm inner diameter, 5 mm outer diameter and 100 mm length, for example, pH300 manufactured by Phillips Co. is used.

As the connection method, one end of the body tube 11 and one extension tube 14A are chucked to a glass lathe with their opening ends being opposed each other and the outer portion of the connection portion is fused by heating from the outside by a burner 16 while rotating the both tube by contact with each other (FIG. 2(*b*)).

In the same manner, the end of the body tube 11 on the opposite side and the other extension tube 14B are chucked to a glass lathe with their opening ends being opposed each other and the outer portion of the connection portion is fused by heating from the outside by a burner 16 while rotating the both tube by contact with each other (FIG. 2(*c*)).

Thus, positioning steps 15 are formed on the openings of both ends of the body tube 11, and the quartz bulb 10 is formed to an entire length of 273 mm in total for the tube body 11 and the extension tubes 14A and 14B (FIG. 2(*d*)).

Further, the thus prepared quartz bulb 10 can be manufactured at an extremely lower cost compared with existent quartz bulbs manufactured entirely by using quartz tube at high purity.

In this example, a both end open type is used for the extension tube 14A, and a type opened at one end and closed at the other end is used as the extension tube 14B.

Further, when a welding operation is performed, it is necessary to control the heating power or a pressing force to the extension tubes 14A and 14B so that the opening of the body tube 11 as a reference surface for the positioning step 15 is not deformed.

[Electrode Mount]

Electrode mounts 20A and 20B are formed each by welding a tungsten electrode 23 of ϕ0.3 mm×about 9 mm length and having a coil 23*a* attached to the top end thereof by way of a molybdenum foil 22 of 2 mm width×18 mm length to the top end of an electrode lead 21 comprising a molybdenum wire of 0.5 mmϕ×15 mm length (FIG. 3(*a*), FIG. 4(*b*)).

Further, a metal engagement engaged to the positioning step 15 is attached as a positioning engagement 24 to the electrode lead 21 at a position spaced apart by a predetermined length from the top end of the electrode.

In this example, a molybdenum foil of 2.5 mm width×20 mm length which is larger than the inner diameter of the sealing portions 13A and 13B and smaller than the inner diameter of the extension tubes 14A and 14B is welded.

Thus, since the positioning engagement 24 enters the inside of the extension tubes 14A and 14B but does not enter the body tube 11, it is engaged at the positioning step 15 formed to the opening end of the body tube 11.

The metal engagement as the positioning engagement 24 is, for example, spot welded to a lead wire using a jig in which the size from the top end of the electrode 23 to the end of the positioning engagement 24 on the side of the electrode is made accurately the same length.

In this example, the top end of the electrode 23 is situated at a position 0.5 mm from the center of the chamber 12 so as to define the arc length to 1.0 mm when the electrode mounts 20A and 20B are sealed in the sealing portions 13A and 13B.

As also illustrated in FIG. 1(*a*), a bent portion may be formed by bending the electrode lead 21 at a position of a predetermined length from the top end of the electrode as the positioning engagement portion 24.

Accordingly, since the positioning engagement portion 24 is engaged at the positioning step 15 by the own weight of the electrode mount 20A when the quartz bulb 10 is caused to stand with the opening 17A or 17B on the insertion side being situated above and the top end of the tungsten electrode 23 is situated at a previously designed height in this state, the electrode position in the chamber 12 can be positioned at a high accuracy for the electrode mount 20A and 20B

[First Electrode Mount Sealing Step]

After heat treating the quartz bulb 10 in vacuum, the first electrode mount 20A is inserted from the opening 17A on the side of the extension tube 14A (FIG. 3(*a*) to (*b*)).

After connecting a vacuum pump (not illustrated) to the opening 17A and evacuating the inside of the quartz bulb 10 by the vacuum pump, an argon gas is filled at 13 kPa and, in this state, the opening end 17A of the extension tube 14A is melted by heating and sealed temporarily (FIG. 3(*c*)).

Thus, inside of the quartz bulb is kept at a negative pressure and the metal of the electrode mount 20A is not oxidized when the sealing portion 13A is sealed.

Then, in a state of standing the quartz bulb 10 with the opening 17A on the insertion side being situated above, the sealing portion 13A is sealed by heat melting (FIG. 3(*d*)).

In the sealing fabrication, the sealing portion 13A is melted and sealed successively while transiting the portion to be heated by moving a burner 16 from the side of the chamber 12 of the sealing portion 13A toward the upper opening 17A.

Thus, the sealing portion 13A is sealed at first on the side of the chamber 12. Since the vicinity of the positioning step 15 as a reference for positioning the electrode mount 20A is not yet heated in this state, the electrode mount 20A is successively sealed from the side of the chamber 12 below while keeping the positional relation when it is inserted.

Then, when the sealing portion 13A in the vicinity of the molybdenum foil 22 is melted along with movement of the burner 16, the molybdenum foil 22, the electrode lead 21, etc. are heated and expanded. However, since the positioning engagement portion 24 is merely placed on the positioning step 15, even when the entire electrode mount 20A is thermally expanded, the positioning engagement portion 24 detaches upward from the positioning step 15 and elongation caused by the expansion is released upward.

Accordingly, even when thermal expansion is caused during sealing, since the molybdenum foil 22 and the electrode leads 21 are not forced excessively the molybdenum foil 22 is neither bent nor twisted.

Then, by moving the burner 16 as far as the vicinity of the positioning step 15, the sealing portion 13A of the body tube 11 is completely sealed.

[Second Electrode Mount Seal Step]

Then, the second electrode mount 20B is inserted through the extension tube 14B on the opposite side and sealed.

At first, the top end of the extension tube 14B is cut neatly so as to be in perpendicular to the longitudinal direction thereof, mercury is injected by about 17 mg from the opening 17B to the inside of the chamber 12 and the second electrode mount 20B having the constitution identical with that of the first electrode mount 20A is inserted (FIG. 4(*a*) to (*c*)).

Then, after connecting a vacuum pump (not illustrated) to the opening 17B and evacuating the inside of the quartz bulb 10 by the vacuum pump, an argon gas containing a trace amount of a bromine compound is filled and, in this state, the top end 17B of the extension tube 14B is temporarily sealed by heat melting.

Thus, the inside of the quartz bulb is kept at a negative pressure, and the metal of the electrode mount 20B is not oxidized when the sealing portion 13B is sealed.

Then, in a state of standing the quartz bulb 10 with the opening 17B on the insertion side being situated above and immersing a part of the chamber 13 as the light emitting without reaming the body tube of portion in a coolant comprising liquid nitrogen, the sealing portion 13B is sealed in the same manner as in the sealing for the first electrode mount 20A, and the second electrode mount 20B is sealed (FIG. 4(*e*)).

Also in this case, even when the electrode mount 20B is expanded thermally during the sealing, since the molybdenum foil 22 and the electrode lead 21 are not forced excessively, the molybdenum foil 22 is neither bent nor twisted and the sealing portion 13B of the body tube 11 is completely sealed.

[Annealing Step]

Then, after sealing both of the electrode mounts 20A and 20B, the quartz bulb 10 is annealed entirely in a state of holding the electrode lead 21 air tightly in each of the extension tubes 14A and 14B before cutting both ends of the quartz bulb 10 for removing strains caused in the quartz.

[Cutting Step]

After the end of the annealing step, the ends of the quartz bulb 10 containing the electrode mounts 20A and 20B sealed therein are cut off and the respective extension tubes 14A and 14B are removed to form the quartz bulb 10 to a predetermined length, thereby completing the super-high pressure mercury lamp 1 (FIG. 1(*d*) to (*e*)).

In this case, the ends of the body tube 11 are cut only slightly for adjusting the length and most of the portions to be removed are the extension tubes 14A and 14B. Since the extension tubes 14A and 14B are formed of an inexpensive material at a lower quartz purity compared with that of the body tube 11, there is no wasteful loss of discarding expensive quartz tube at high purity and the manufacturing cost can also be decreased.

Then, when the super-high pressure mercury lamp 1 manufactured as described above was subjected to X-ray measurement, the arc length thereof was entirely contained in a range of 1.0 mm±0.1 mm as designed and, further, there were no troubles such as twisting of the molybdenum foil 22.

Further, the lamp 1 was set to a concave reflection mirror as a cold mirror (not illustrated) and fixed such that the focal point is situated between the electrodes 23 and 23 causing discharge arc, thereby manufacturing a light source unit for a liquid crystal projector.

When the thus manufactured light source unit is mounted to a liquid crystal projector small in size and light in weight, and a comparative life test was conducted by lighting using a predetermined electronic ballast (repetitive cycle of put-on for 5 hours and put-off for 1 hour), also the light source unit assembled with the super-high pressure mercury lamp 1 manufactured by the method according to the invention results in no problems at all at the time of reaching the rated life of 2000 hours and the retaining rate for lightness was also satisfactory.

INDUSTRIAL APPLICABILITY

As has been described above, the present invention is applicable to the use of manufacturing a so-called double ended type tipless lamp in which a chamber as a light emitting portion is formed to a longitudinally intermediate portion of a quartz tube, and a straight tubular sealing portions are formed on both ends thereof.

DESCRIPTION FOR REFERENCE NUMERALS

Figures 1A, 1B, 1C, 1D, 1E:
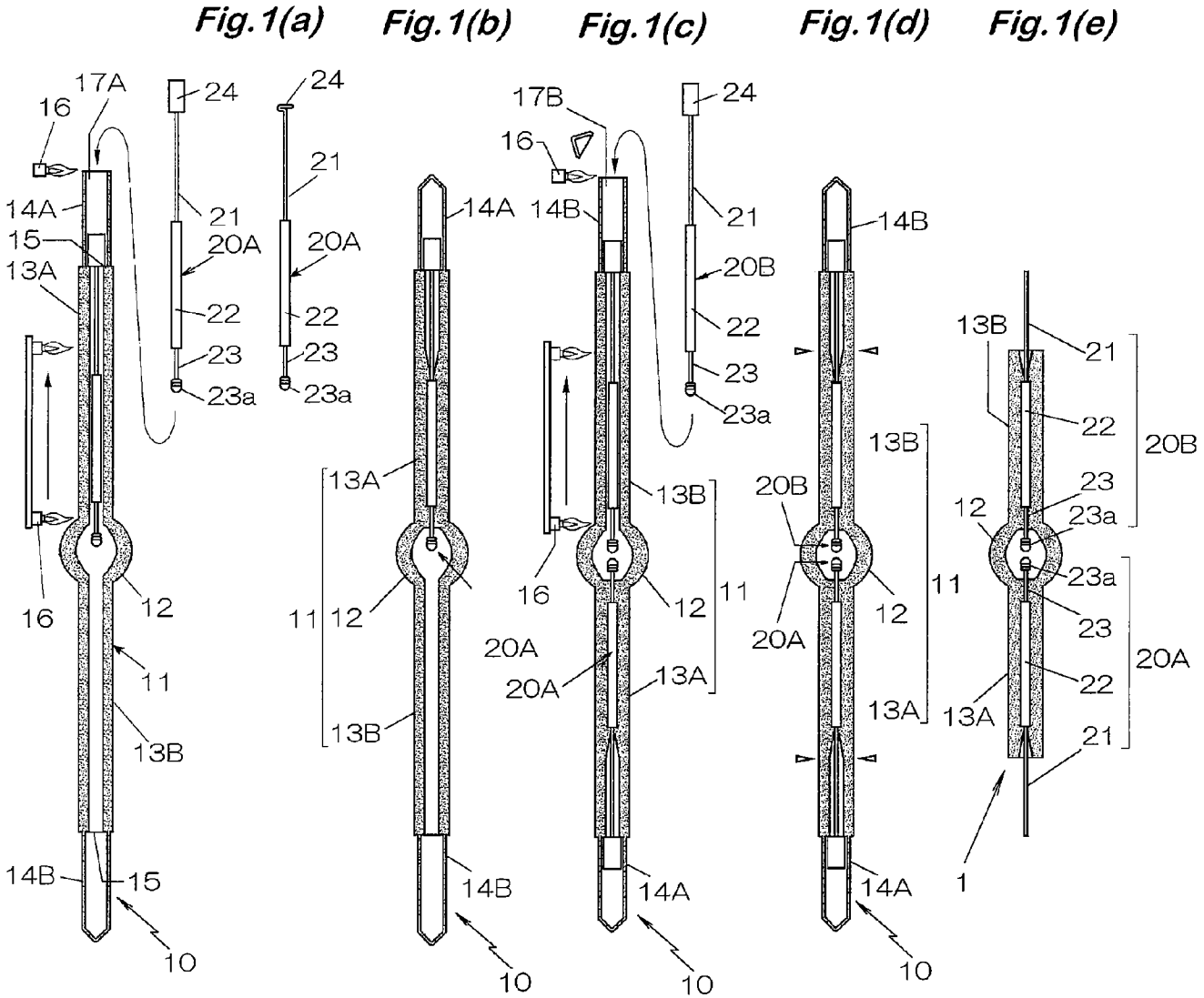
FIG. 1 is an entire step view showing an example of a method of manufacturing a lamp according to the invention.
Figures 2A, 2B, 2C, 2D:
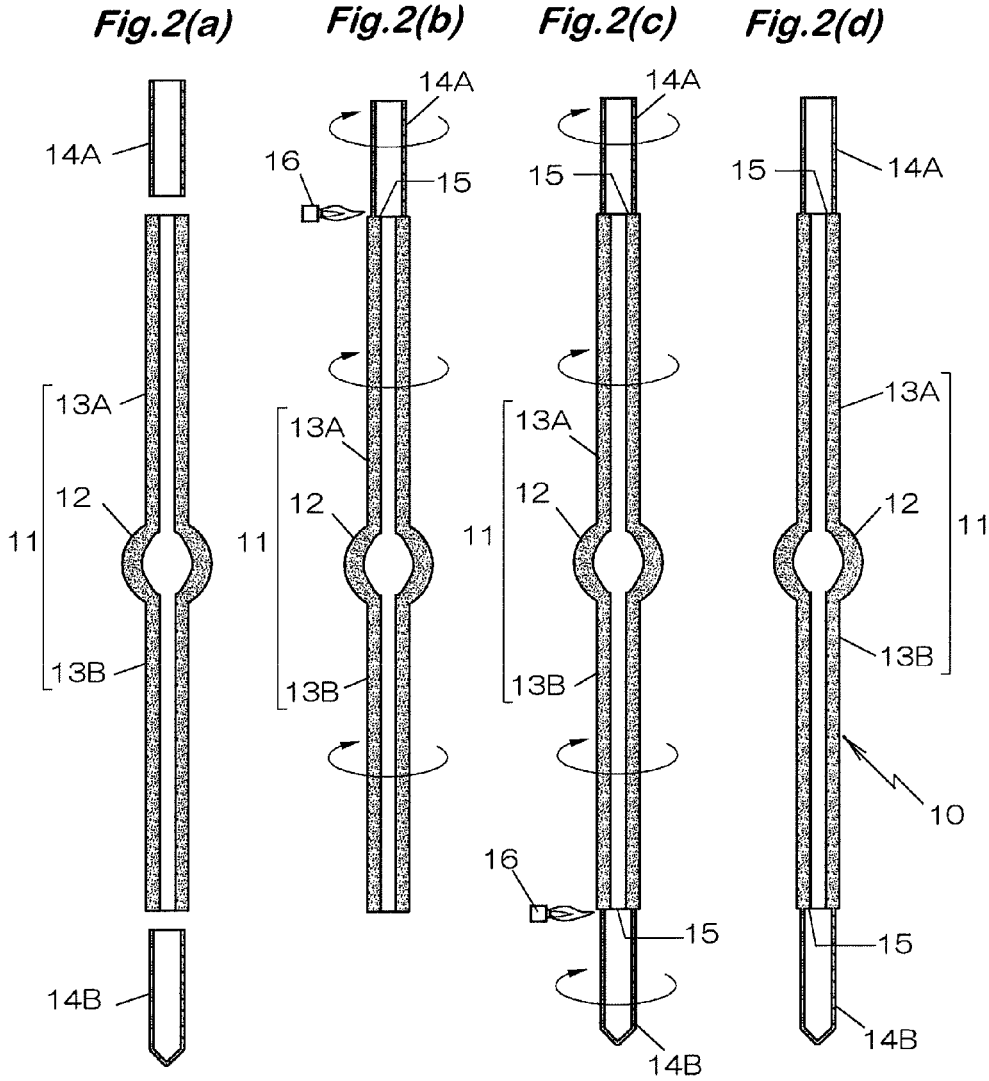
FIG. 2 is a manufacturing step view showing steps of manufacturing a quartz bulb.
Figures 3A, 3B, 3C, 3D:
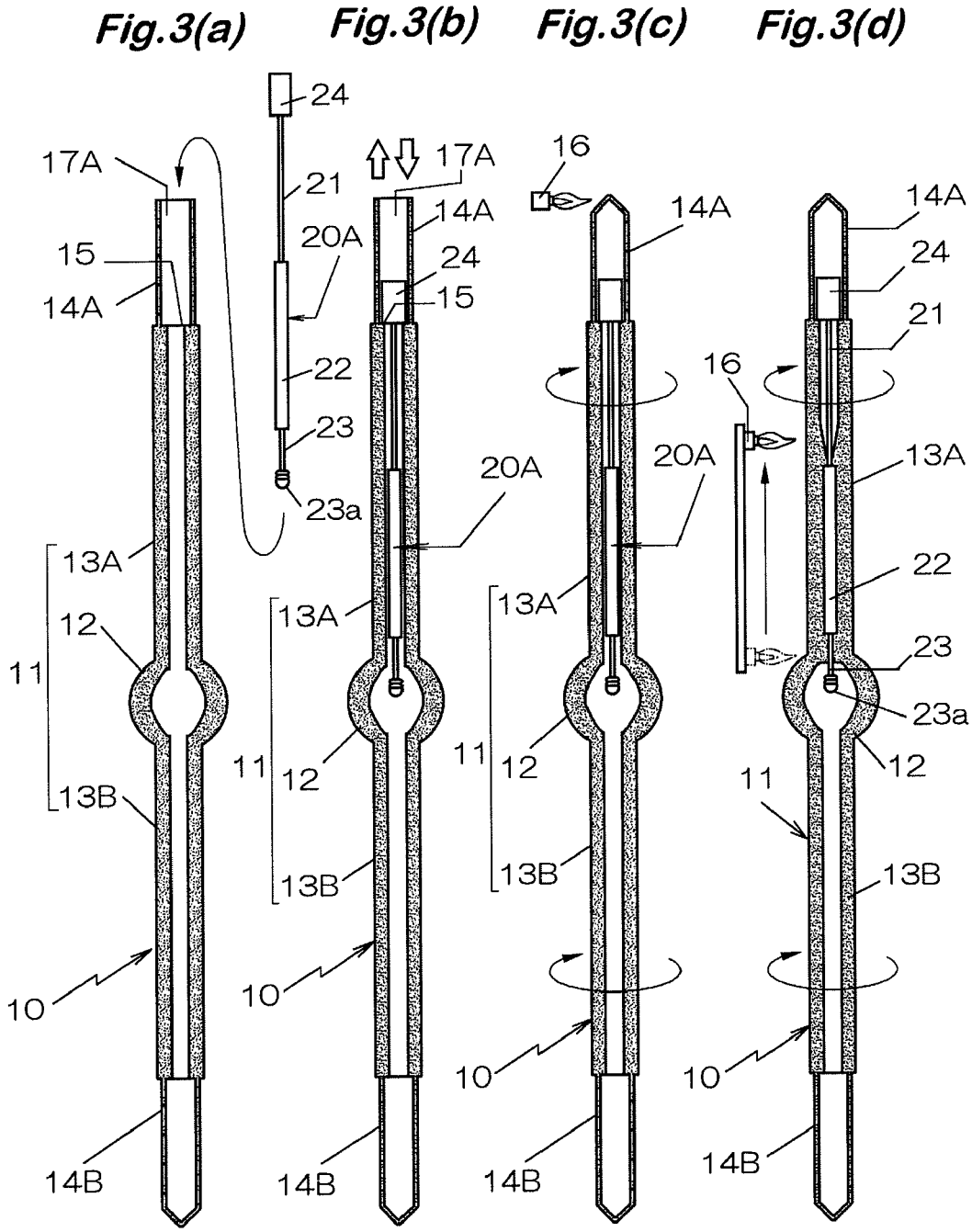
FIG. 3 is a step view for sealing one of electrode mounts.
Figures 4A, 4B, 4C, 4D, 4E:
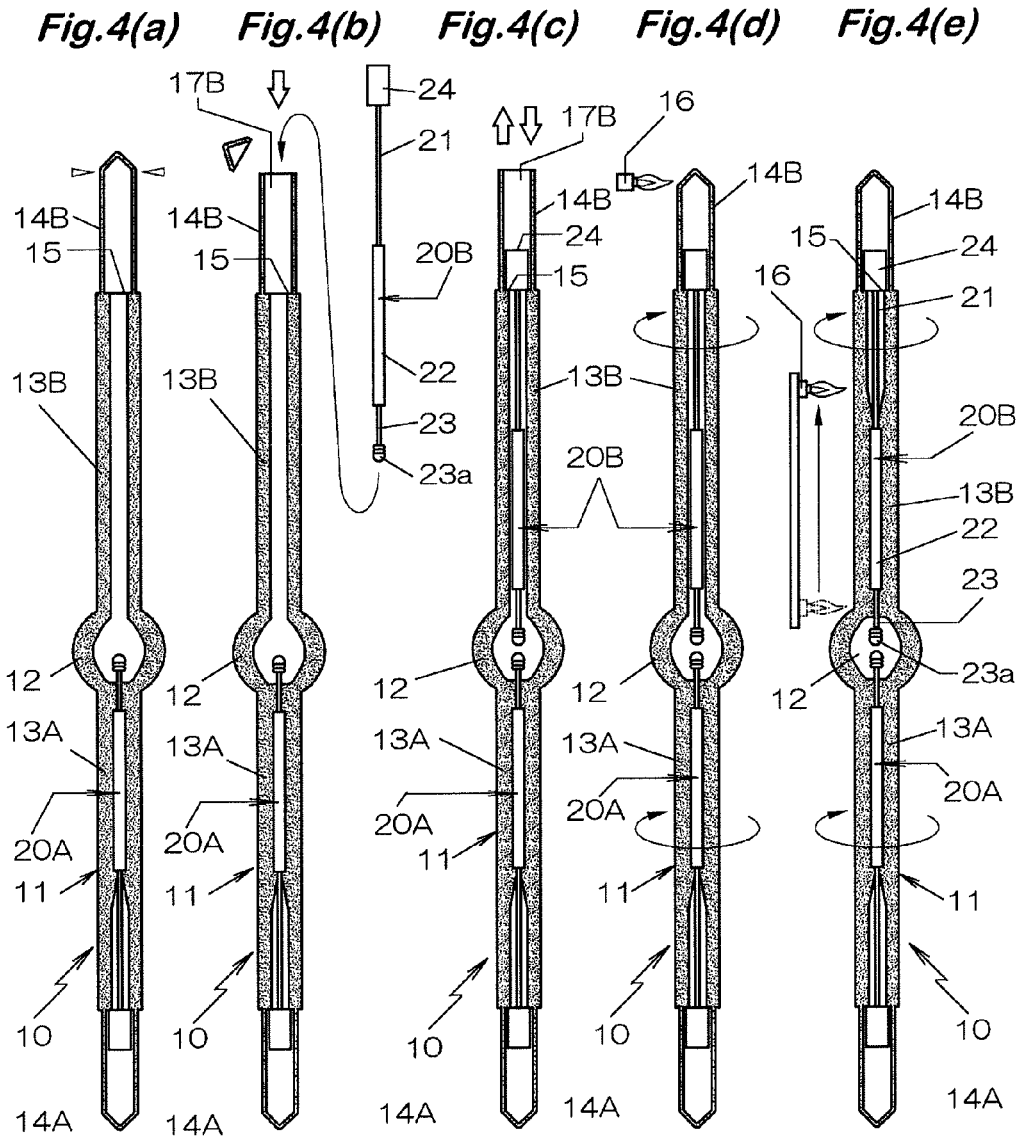
FIG. 4 is a step view for sealing the other of electrode mounts.
Figures 5A, 5B, 5C:
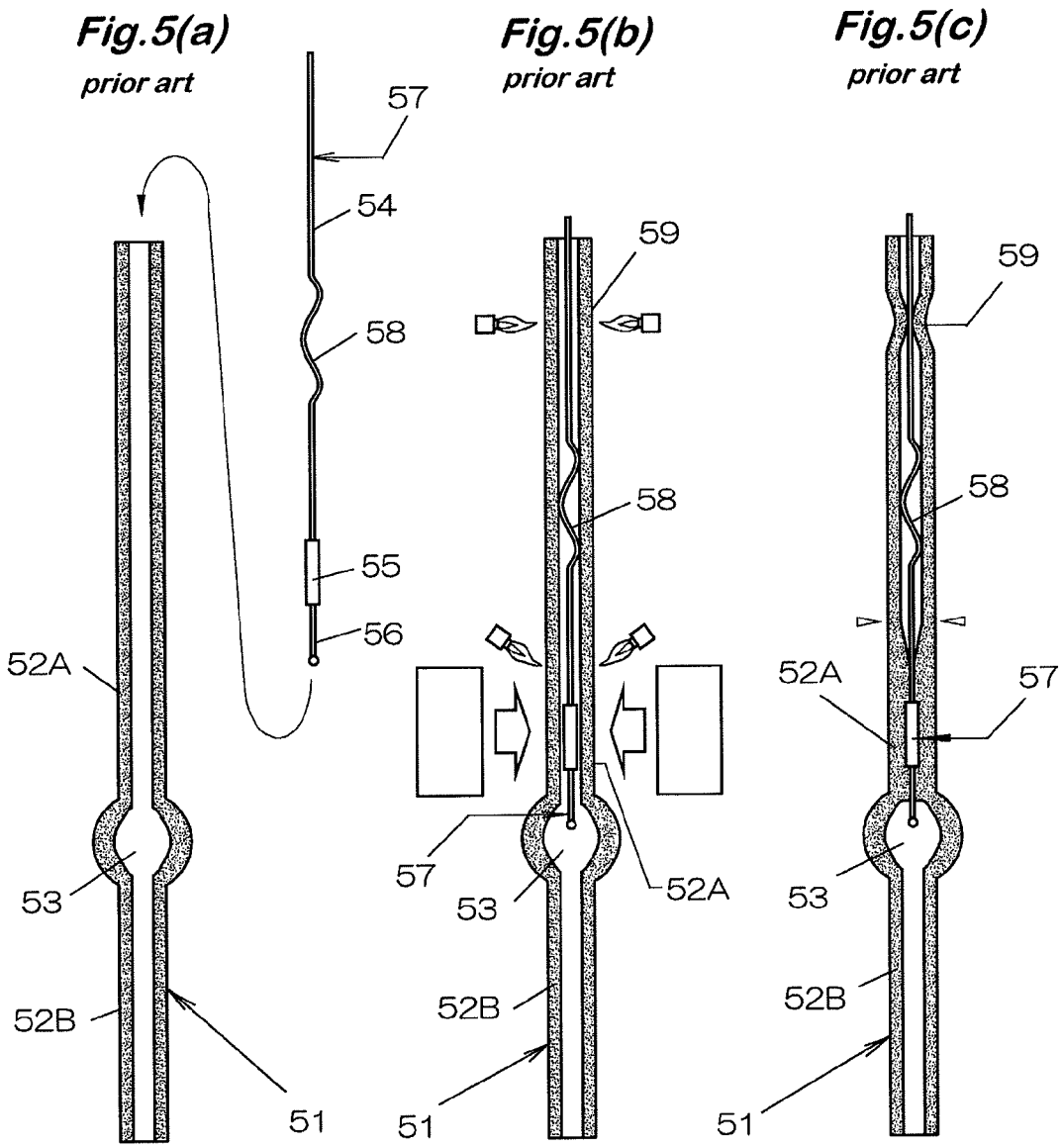
Fig.5(a) prior art
Fig.5(b) prior art
Fig.5(c) prior art
FIG. 5 is an explanatory view showing an existent method.
Figures 6A, 6B:
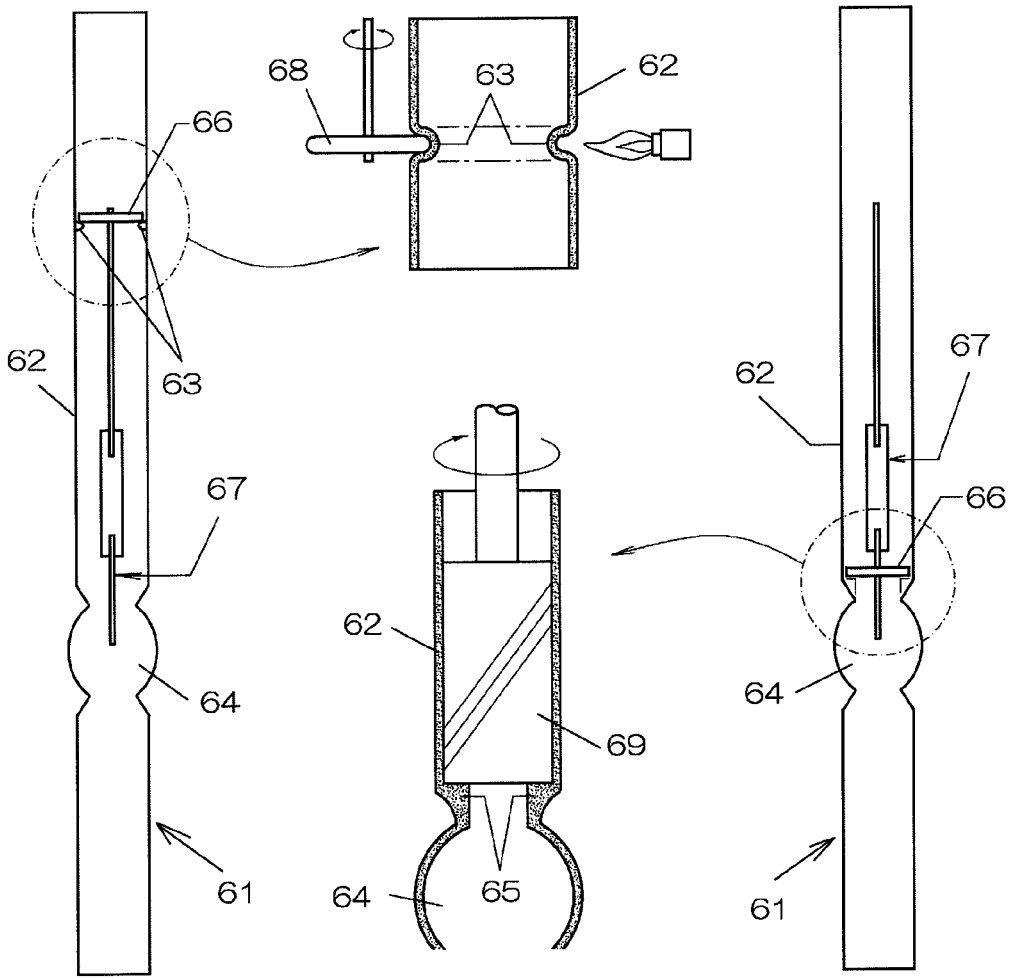
Fig.6(a) prior art
Fig.6(b) prior art
FIG. 6 is an explanatory view showing another existent method.

1 super-high pressure mercury lamp
10 quartz bulb
11 body tube
12 chamber
13A, 13B sealing portion
14A, 14A extension tube
15 positioning step
16 burner
17A, 17B opening
20A, 20B electrode mount
21 electrode lead
33 molybdenum foil
23 tungsten electrode
23*a* coil
24 positioning engagement portion

What is claimed is:

1. A method of manufacturing a lamp including a quartz bulb having a chamber formed as a light emitting portion provided at a longitudinally intermediate portion of a quartz tube having straight tubular sealing portions extending from end portions of the longitudinally intermediate portion, wherein at least one electrode mount is inserted into the quartz bulb through an opening of one of the sealing portions toward the light emitting portion and the sealing portions are sealed to maintain an interior space of the quartz bulb at a negative pressure, wherein the method includes:

forming a positioning step on the quartz bulb by welding an extension tube having an inner diameter larger than an inner diameter of the opening of at least one of the sealing portions to the opening of the one sealing portion, forming a positioning engagement portion on the electrode mount at a position spaced by a predetermined length from a top end of the electrode mount, inserting the electrode mount into the quartz bulb from the opening of the sealing portion having the formed positioning step, maintaining the opening of the sealing portion disposed at the opposite side of the longitudinally intermediate portion in a sealed state, temporarily sealing the opening of the sealing portion having the formed positioning step while maintaining the interior space at a negative pressure, standing the quartz bulb and engaging the positioning engagement portion of the electrode mount with the formed positioning step, sealing the sealing portion having the formed positioning step in a transiting manner from the light emitting portion toward the opening of the sealing portion having the formed positioning step, thereby sealing the electrode mount to the quartz bulb, and cutting ends of the quartz bulb and removing the at least one extension tube to form the quartz bulb having a predetermined length.

2. The method for manufacturing the lamp according to claim 1, wherein the positioning step is formed at the openings of both sealing portions of the quartz bulb, and a pair of electrode mounts are inserted from into the openings of both sealing portions and sealed successively in the transiting manner.

3. The method for manufacturing the lamp according to claim 1, wherein the electrode mount is formed by welding a tungsten electrode by way of a molybdenum foil to a top end of an electrode lead, and an engagement made of metal that is to be engaged as the positioning engagement portion on the positioning step is attached to the electrode lead at a position spaced by a predetermined length from the top end of the electrode.

4. The method for manufacturing the lamp according to claim 1, wherein the electrode mount is formed by welding a tungsten electrode by way of a molybdenum foil to a top end of an electrode lead, and the positioning engagement portion is formed as a bent portion by bending the electrode lead at a position spaced by a predetermined length from the top end of the electrode.

5. The method for manufacturing the lamp according to claim 1, wherein the lamp is annealed entirely in a state of holding an electrode lead connected to the electrode mount in the extension tube airtightly after sealing the electrode mount and before cutting the ends of the quartz bulb.

6. A quartz bulb used for manufacturing a lamp comprising:

a chamber formed as a light emitting portion at a longitudinally intermediate portion of a quartz tube; and straight tubular sealing portions provided on both ends of the chamber to form a body tube, wherein a positioning step is provided at a first open end of one of the straight tubular sealing portions, the positioning step being formed by an extension tube welded to the first open end such that the extension tube has an inner diameter larger than an inner diameter of the first open end and an outer diameter smaller than an outer diameter of the first open end.

7. The quartz bulb according to claim 6, wherein the extension tube is a quartz of a lower purity than a quartz of the body tube.

8. The quartz bulb according to claim 6, wherein the extension tube is a quartz tube having a wall thickness smaller than a wall thickness of the body tube.

9. The quartz bulb according to claim 6, wherein the positioning step is provided at opposing openings of the body tube.

10. The method for manufacturing the lamp according to claim 2, wherein the lamp is annealed entirely in a state of holding an electrode lead connected to the electrode mount in the extension tube airtightly after sealing the electrode mount and before cutting the ends of the quartz bulb.

11. The method for manufacturing the lamp according to claim 3, wherein the lamp is annealed entirely in a state of holding the electrode lead connected to the electrode mount in the extension tube airtightly after sealing the electrode mount and before cutting the ends of the quartz bulb.

12. The method for manufacturing the lamp according to claim 4, wherein the lamp is annealed entirely in a state of holding the electrode lead in the extension tube airtightly after sealing the electrode mount and before cutting the ends of the quartz bulb.

13. The quartz bulb according to claim 7, wherein the extension tube is a quartz tube having a wall thickness smaller than a wall thickness of the body tube.

* * * * *